US012071831B1

(12) United States Patent
Rogers et al.

(10) Patent No.: US 12,071,831 B1
(45) Date of Patent: Aug. 27, 2024

(54) INTEGRAL SWIVEL FOR MULTIPLE STAGE CEMENTING TOOLS APPARATUS AND METHOD OF USE

(71) Applicant: Citadel Casing Solutions LLC, Houston, TX (US)

(72) Inventors: Henry E Rogers, Owasso, OK (US); Carlos A Valdez, Humble, TX (US); Gary J Makowiecki, Spring, TX (US)

( * ) Notice: Subject to any disclaimer, the term of this patent is extended or adjusted under 35 U.S.C. 154(b) by 0 days.

(21) Appl. No.: 18/535,871

(22) Filed: Dec. 11, 2023

(51) Int. Cl.
*E21B 33/14* (2006.01)

(52) U.S. Cl.
CPC ..... *E21B 33/146* (2013.01)

(58) Field of Classification Search
CPC ..... E21B 33/146; E21B 17/05
See application file for complete search history.

(56) References Cited

U.S. PATENT DOCUMENTS 5,038,862 A 8/1991 Giroux et al.
5,277,253 A 1/1994 Giroux et al.
5,279,370 A 1/1994 Brandell et al.
5,314,015 A 5/1994 Streich et al.
5,348,089 A 9/1994 Brandell et al.
9,970,258 B2 * 5/2018 Barannikow ..... E21B 34/10
2004/0094309 A1 * 5/2004 Maguire ..... E21B 43/103 166/242.6
2007/0012448 A1 * 1/2007 Rogers ..... E21B 33/165 166/291
2016/0024877 A1 * 1/2016 Coronado ..... E21B 34/10 166/177.4
2017/0081927 A1 * 3/2017 Leiper ..... E21B 17/05
2017/0218708 A1 * 8/2017 Eidem ..... E21B 17/1057

* cited by examiner

*Primary Examiner* — Shane Bomar
(74) *Attorney, Agent, or Firm* — Avek IP, LLC

(57) ABSTRACT

A tool and method for selectively allowing a transmission of torque to a casing string at a position below installation of the tool along the casing string. The tool includes an upper body to engage with an upper portion of a casing string, a lower body to engage with a lower portion of a casing string, and a swivel assembly connecting the upper body to the lower body, the swivel assembly is to operate in multiple configurations such that the upper body and the lower body are selectively locked together to allow or prevent torque transmission through the tool from the upper portion of the casing string to the lower portion of the casing string.

8 Claims, 9 Drawing Sheets

INTEGRAL SWIVEL FOR MULTIPLE STAGE CEMENTING TOOLS APPARATUS AND METHOD OF USE

FIELD OF THE DISCLOSURE

The disclosure relates generally to cementing tools. More specifically, the disclosure relates to a tool and method of use for selectively allowing or preventing the transmission of torque through the tool from an upper portion of a casing string to a lower portion of the casing string.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to an integral swivel tool for selectively allowing a transmission of torque to a casing string at a position below installation of the integral swivel tool along the casing string. The integral swivel tool comprising an upper body configured to engage with an upper portion of the casing string; a lower body configured to engage with a lower portion of the casing string; and a swivel assembly connecting the upper body to the lower body, the swivel assembly is configured to operate in a first configuration, a second configuration, and a third configuration to selectively allow the transmission of torque through the swivel assembly. The first configuration locks the upper body and the lower body such that torque can be transmitted from the upper portion of the casing string to the lower portion of the casing string through the integral swivel tool. The second configuration unlocks the upper body from the lower body such that torque is not transmitted from the upper portion of the casing string to the lower portion of the casing string through the integral swivel tool, the second configuration further opening one or more circulation ports for fluid flow through the swivel assembly. The third configuration blocks the circulation ports, the third configuration allowing for the integral swivel tool to be drilled out to a full-bore flow path through the integral swivel tool while maintaining pressure integrity.

In other aspects, the present invention relates to a method of selectively allowing a transmission of torque to a casing string at a position below installation of an integral swivel tool along the casing string. The method comprising first installing the integral swivel tool along a midpoint of the casing string, the integral swivel tool having an upper body to engage with an upper portion of the casing string, a lower body to engage with a lower portion of the casing string, and a swivel assembly connecting the upper body to the lower body, the swivel assembly configured to operate in a first configuration, a second configuration, and a third configuration. Next, running the casing string and the integral swivel tool into a wellbore, the swivel assembly starting in the first configuration such that the upper body and the lower body are rotationally locked and torque applied to the upper portion of the casing string is transferred to the lower portion of the casing string. Then, performing one or more pumping operations. Next, converting the swivel assembly into a second configuration, the second configuration unlocking the upper body from the lower body such that torque no longer transfers from the upper portion of the casing string to the lower portion of the casing string. Next, performing one or more fluid circulation operations such that fluid is circulated from inside of the swivel assembly to outside the swivel assembly through one or more circulation ports. Then, converting the swivel assembly into a third configuration, the third configuration blocking the one or more circulation ports. Finally, allowing the integral swivel tool to be drilled out to create a full-bore flow path through the integral swivel tool.

BRIEF DESCRIPTION OF THE SEVERAL VIEWS OF THE DRAWINGS

Illustrative embodiments of the present disclosure are described in detail below with reference to the attached drawing figures.

Figure 1:
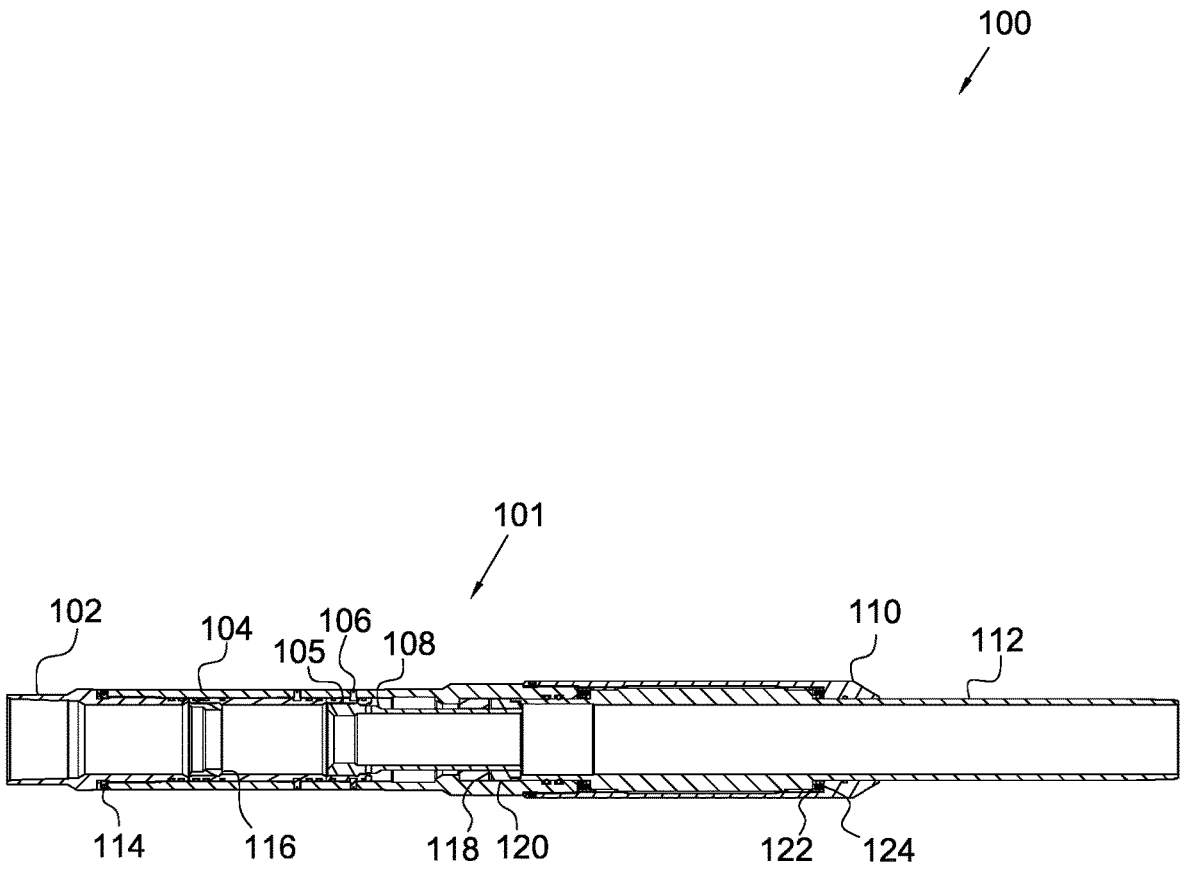
FIG. 1 is a side, cross-sectional view of an integral swivel tool in a first configuration in accordance with the present invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. During drilling operations, sections of casing string are run into the well, wherein cementing operations are performed to create structural integrity around the casing string. These operations take extensive time and resources, and accordingly, it is desirable to improve efficiency.

The present invention provides for an integral swivel tool and method of use that, when used during cementing operations, improves cement slurry placement and displacement efficiency of the drilling fluids. This results in improved zonal isolation between the casing and the wellbore, which further results in an improved lifespan of the well isolation.

The present invention relates to a stage cementing tool, namely an integral swivel tool, that is installed mid-point of a casing string. The tool incorporates a swivel capability that enables full string rotation while running casing and while in a first configuration. The first configuration is the as assembled configuration and may also be referred to as an unopen configuration. While in the first configuration, fluid circulation can be performed through the tool, and rotation and torque can be transferred through the tool from an upper portion of the casing string to a lower portion of the casing string. Once the casing is run to a total depth, first stage pumping operations can be performed while the tool is in the first configuration.

If applicable, the tool allows for unlocking and conversion into a second configuration, which therefore eliminates the transfer of rotation and torque between the upper portion of the casing string to the lower portion of the casing string and further results in opening one or more circulation ports. Accordingly, in this configuration, fluid circulation from inside to outside of the tool such that fluid can be circulated into the annular space between the casing and the wellbore above the swivel assembly. Casing rotation while circulating fluid improves the displacement efficiency of the fluids in the annular space above the tool.

Once all cement slurry has been pumped from the surface, the tool may be converted into a third configuration, wherein the circulation ports are closed off. The cement slurry can cure, and the integral swivel tool can be drilled out so as to create a full bore flow path through the tool.

Figure 2:
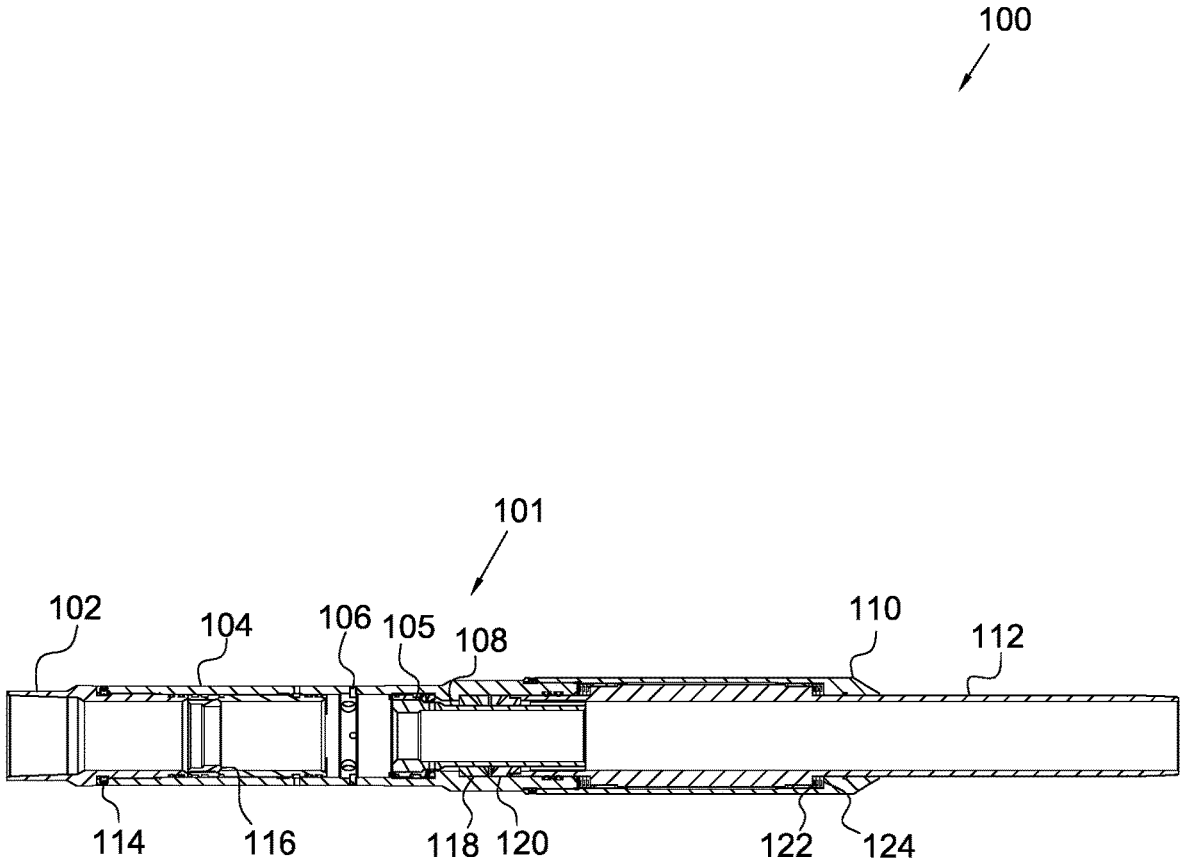
FIG. 2 is a side, cross-sectional view of the integral swivel tool in a second configuration in accordance with the present invention.
Figure 3:
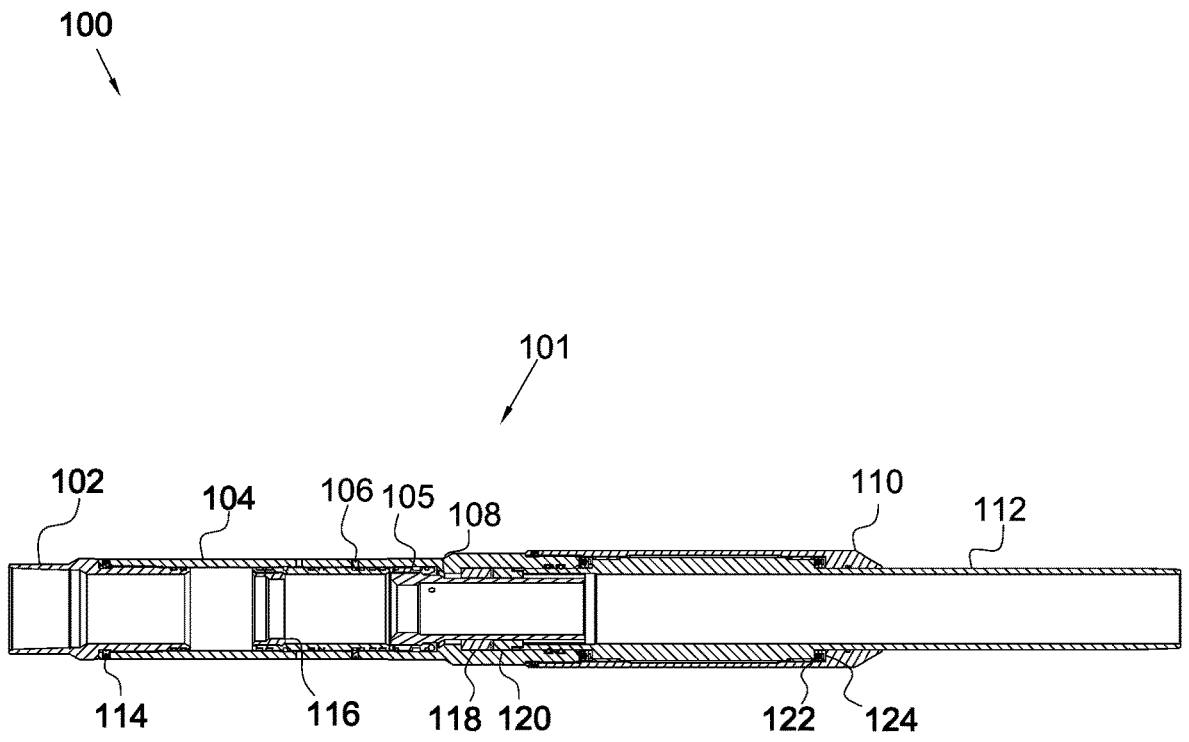
FIG. 3 is a side, cross-sectional view of the integral swivel tool in a third configuration in accordance with the present invention.

In FIGS. 1-3, the three configurations discussed above are depicted in cross sectional views of the integral swivel tool 100. As shown, the tool 100 includes an upper body 102 that is configured to engage with an upper portion of a casing string (not shown) and a lower body 112 configured to engage with a lower portion of the casing string (not shown). A swivel assembly 101 couples to the upper and lower bodies 102, 112 and provides for the three configurations discussed above that allows for selective transmission of torque between the upper portion of the casing string to the lower portion of the casing string, or in other words, between the upper body 102 and the lower body 112 through the swivel assembly 101. Those skilled in the art will appreciate that the components discussed herein may be modified, removed, or replaced between embodiments without departing from the overall functionality and novelty of the present invention. The specific components discussed below are merely exemplary of one embodiment that may be implemented for the functionality discussed above.

In embodiments, the swivel assembly 101 includes a case swivel body 104 mechanically coupled to the upper body 102 and forming a fluid flow path therethrough, the case swivel body 104 having one or more circulation ports 106 extending through a thickness of the body walls. The case swivel body 104 may be coupled to the upper body 102 through a threaded connection 114, however, those skilled in the art may vary the type of connection.

Within the case swivel body 104 is an opening seat 108, the opening seat 108 coupled to an opening sleeve 105 that creates a seal within and to the interior of the swivel body 104 such that the seal is configured to release upon predetermined pressure. In other words, a connection is formed between the opening sleeve 105 and the interior of the body 104, such that the point of connection is only strong enough to withstand up to a predetermined pressure. This feature allows for the opening sleeve 105 along with the opening seat 108 to release from a first position to a second position (i.e. FIG. 1 to FIG. 2) upon the application of pressure. The pressure may be applied by any means known or developed in the art, such as by dropping a free fall opening plug from the surface. This shift in position causes the swivel assembly 101 to convert into the second configuration.

The swivel assembly 101 further includes a closing sleeve 116 positioned within the case swivel body 104 at a position above the opening sleeve 105. The closing sleeve 116 can again vary as would be understood by those skilled in the art and functions to close the circulation ports 106 in the third configuration (see FIG. 3). The closing sleeve 116 may be shifted from a first position to a second position through an application of force, such as through launching of a closing plug. After the closing sleeve 116 has been shifted to close the one or more circulation ports 106, the entire tool 100 may be drilled out so as to create the full-bore flow path through the tool 100.

The swivel assembly 101 further includes a closing sleeve 116 positioned within the case swivel body 104 at a position above the opening sleeve 108. The closing sleeve 116 can again vary as would be understood by those skilled in the art and functions to close the circulation ports 106 in the third configuration (see FIG. 3). The closing sleeve 116 may be shifted from a first position to a second position through an application of force, such as through launching of a closing plug. After the closing sleeve 116 has been shifted to close the one or more circulation ports 106, the entire tool 100 may be drilled out so as to create the full-bore flow path through the tool 100.

In embodiments, an upper torque retainer 118 and a lower torque retainer 120 are used to create the "lock" in the first configuration. The upper torque retainer 118 is mechanically locked to the case swivel body 104 and engaged with the opening seat 108. Similarly, the lower torque retainer 120 is mechanically locked to the lower body 112 and engaged with the opening seat 108. When the opening seat 108 is engaged with the torque retainers 118, 120, the swivel assembly 101 is in the first configuration and accordingly, torque can be transferred through the swivel assembly 101 such that the entire casing string can be rotated when surface torque is applied.

For conversion to the second configuration, the opening sleeve 105 and opening seat 108 are subjected to force or pressure, as discussed above, and disengage from the torque retainers 118, 120 and therefore releases the lower body 112 such that the lower body 112 is not subjected to torque or rotation even when surface torque is applied.

Figure 4:
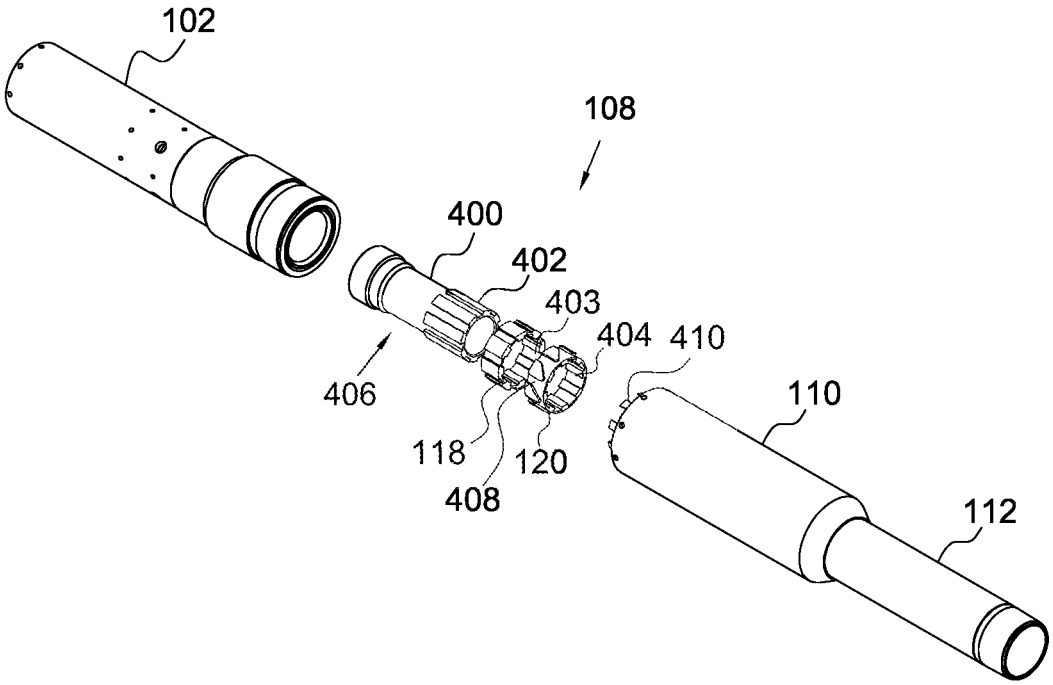
FIG. 4 is an angled, disassembled view of an upper body, a lower body, an opening seat, an upper torque retainer, and a lower torque retainer of the integral swivel tool of the present invention.

As best shown in FIG. 4, in embodiments, the opening seat 108 includes a tubular body 400 with a plurality of splines 402 extending parallel with the tubular body 400. The upper torque retainer 118 includes having a first plurality of interior grooves 403 that correspond with the splines 402 for rotationally locking the upper torque retainer 118 with respect to the opening seat 108. Similarly, the lower torque retainer 120 has a second plurality of interior grooves 404 for corresponding with and locking with the splines 402 to rotationally lock the lower torque retainer 120 with respect to the opening seat 108.

Figure 5A:
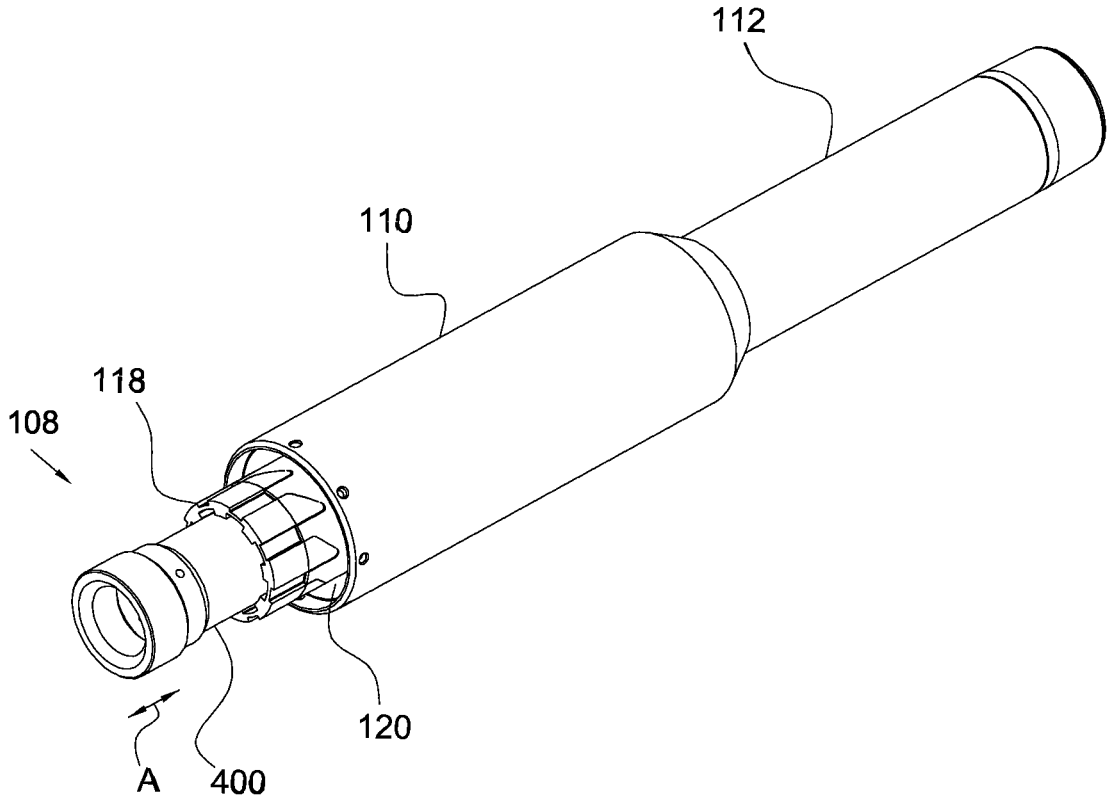
FIG. 5A is an angled view of the opening seat, upper torque retainer, lower torque retainer, and lower body locked together as in the first configuration of the integral swivel tool.
Figure 5B:
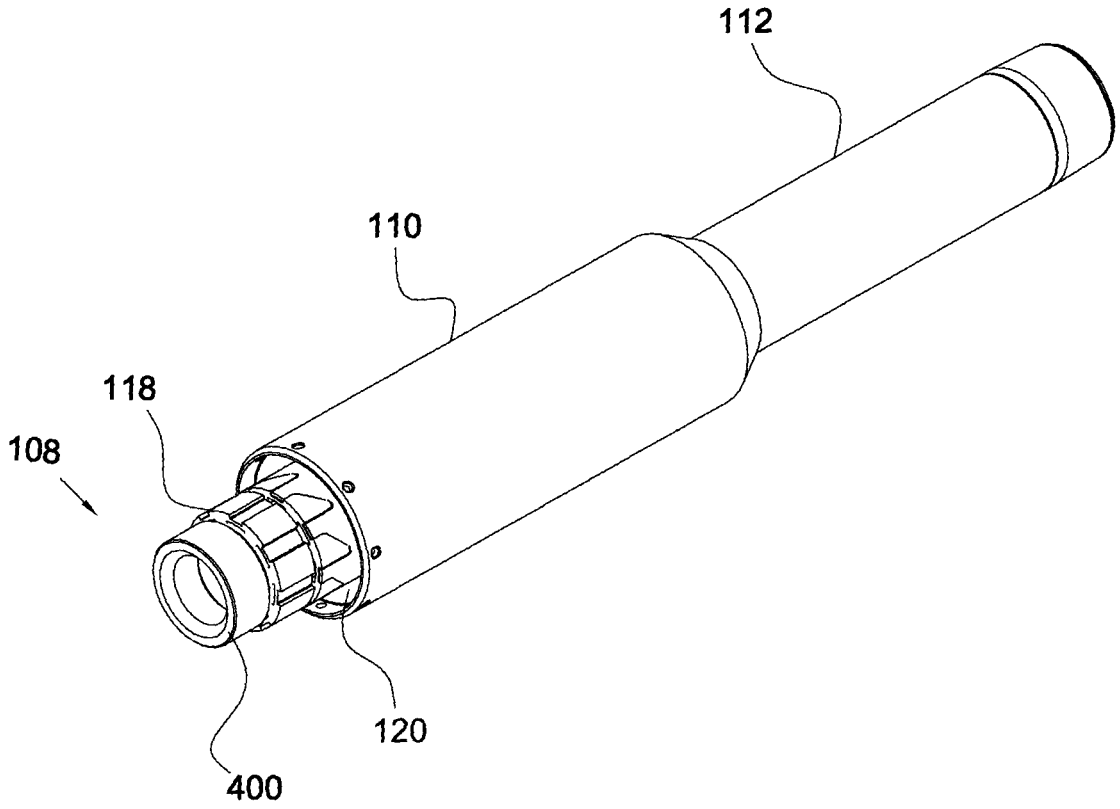
FIG. 5B is an angled view of the opening seat, upper torque retainer, lower torque retainer, and lower body disengaged, as in the second and third configurations of the integral swivel tool.

As shown, in embodiments, the splines 402 only extend partially along the tubular body 400, resulting in a portion 406 of the body 400 that is smooth and spline free. Accordingly, when the predetermined pressure is applied to the opening sleeve 105 and opening seat 108, the tubular body 400 slides through the grooves 403, 404 to unlock, such that torque is no longer applied to the lower body 112 through the upper and lower torque retainers 118, 120. This is best shown in FIGS. 5A and 5B.

Referring back to FIG. 4, the lower torque retainer 120, in embodiments, further includes a plurality of exterior grooves 408 to engage with a plurality of locking members 410 extending from the lower body 112, thereby locking the lower torque retainer 120 with the lower body 112. Again, those skilled in the art may modify this means of connection while not diverting from the functionality and novelty of the present invention.

Figure 6A:
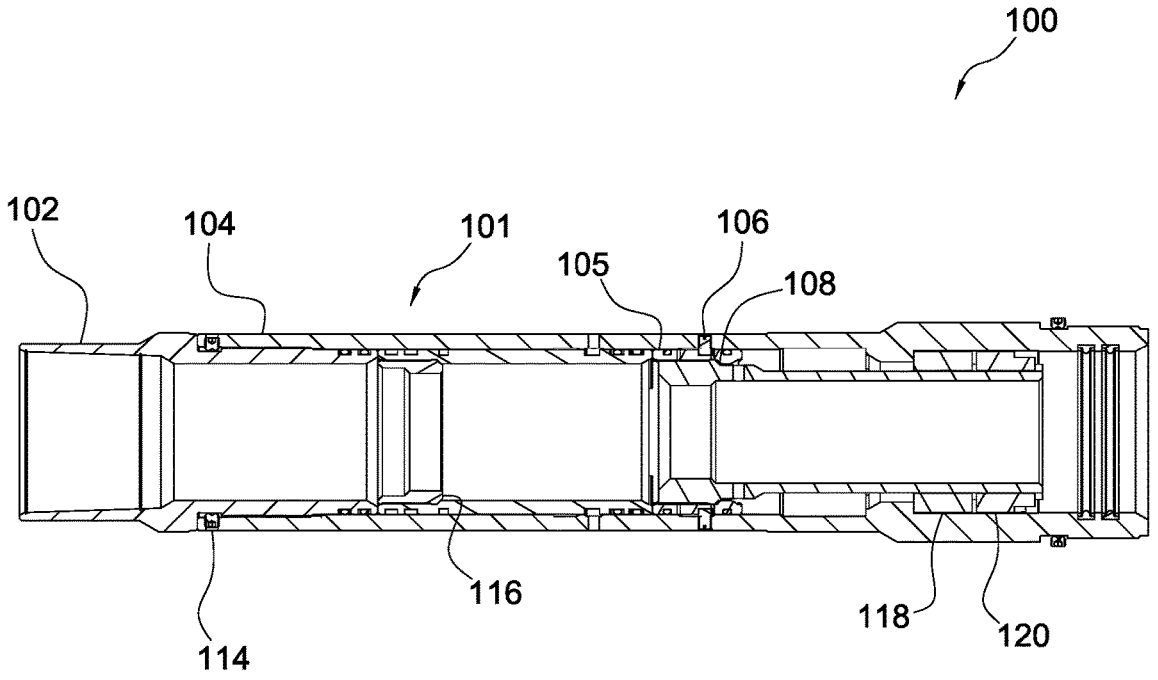
FIG. 6A is a side, cross sectional view of the opening seat and an opening sleeve in the first configuration of the integral swivel tool.
Figure 6B:
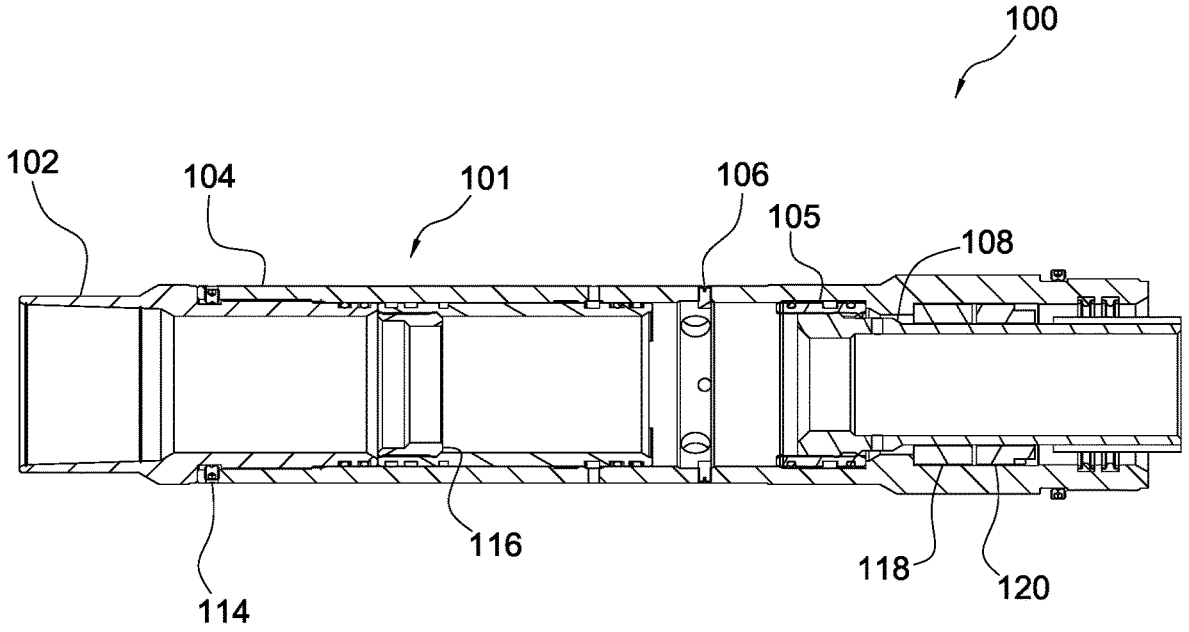
FIG. 6B is a side, cross sectional view of the opening seat and an opening sleeve in the second and third configurations of the integral swivel tool.
Figure 7:
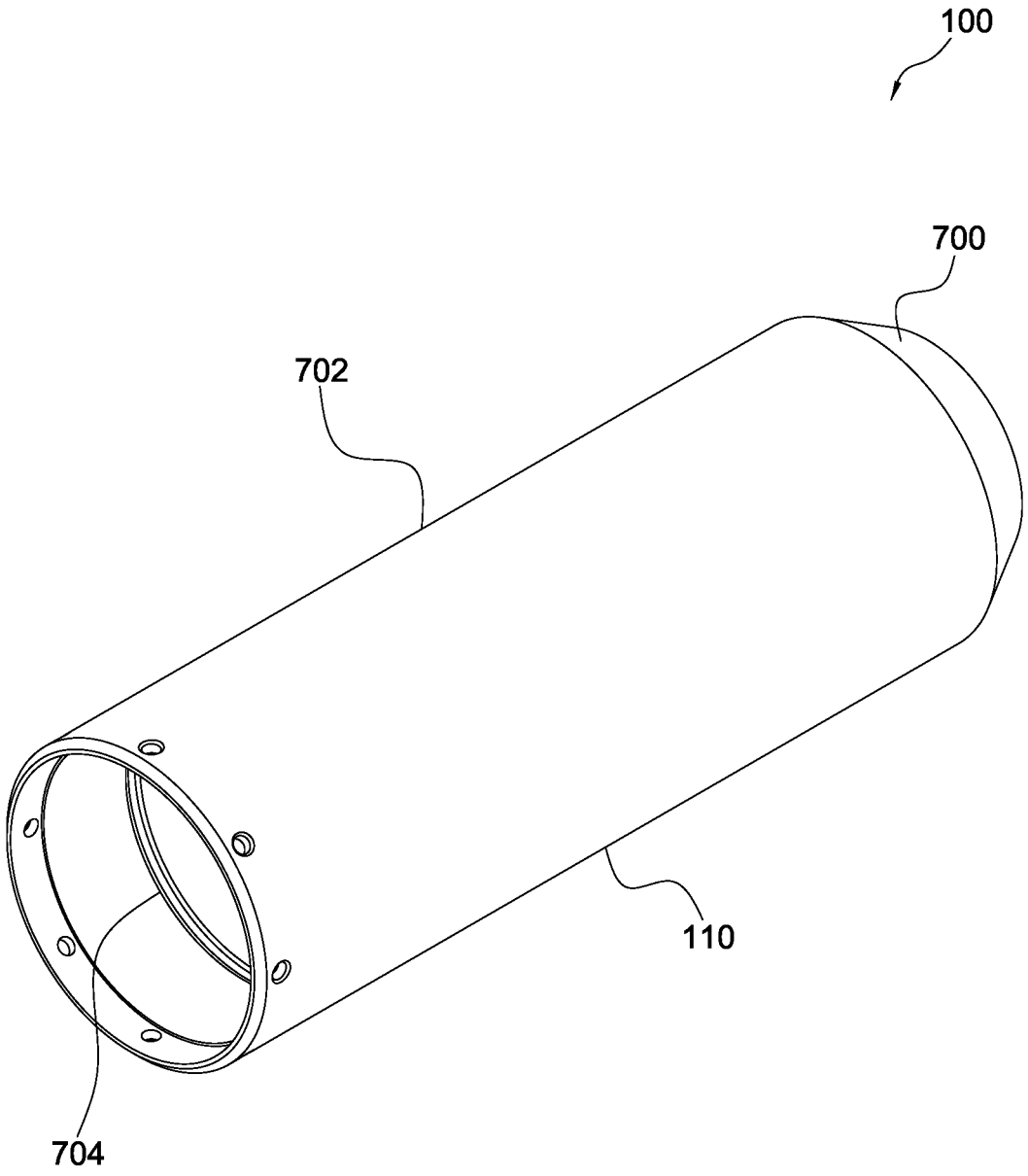
FIG. 7 is an angled view of a swivel retainer in accordance with embodiments of the present application.

In FIGS. 6A and 6B, detailed views of the opening seat 108 as engaged with the opening sleeve 105 in the first and second configurations is shown for clarity. In FIG. 7, an embodiment of the swivel retainer 110 is shown for clarity. Those skilled in the art will appreciate that the swivel retainer may vary. As shown and discussed above, the swivel retainer 110 includes the shelf 124 that extends inwardly such that a lower portion 700 has a diameter less than an upper portion 702. One or more connection points 704 allow for coupling of the swivel retainer 110 to the case swivel body 104. The connection points 704 may vary, such as being a threaded connection.

Figure 8:
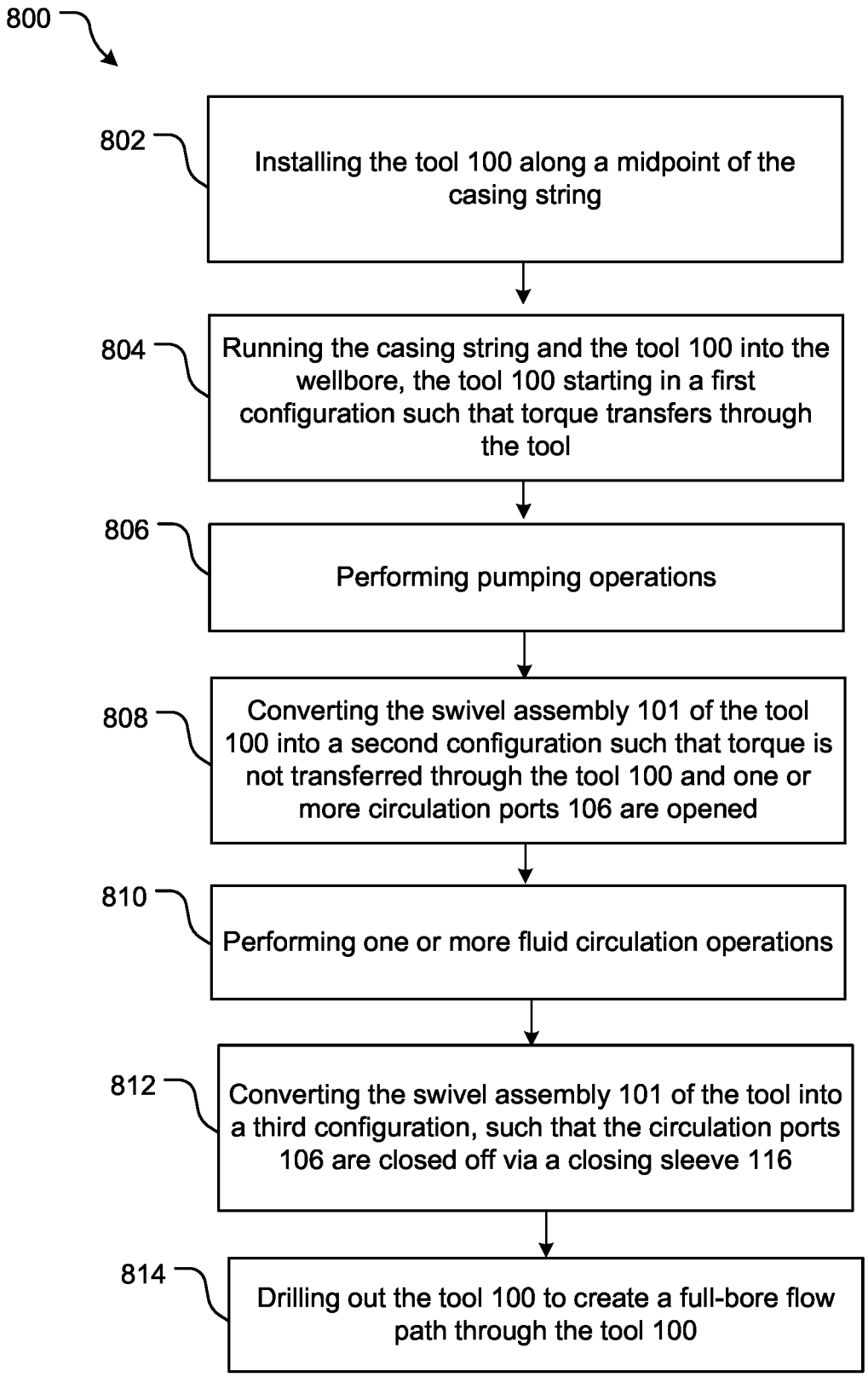
FIG. 8 is a flowchart of a method of selectively allowing a transmission of torque to a casing string at a position below installation of the integral swivel tool.

In FIG. 8, a flowchart 800 depicts the operational steps of the integral swivel tool 100 in accordance with the present invention for a method of selectively allowing transmission of torque through the tool 100 from an upper portion of the casing string to a lower portion of the casing string. At step 802, the tool 100 is installed along a midpoint of the casing string, such that the upper body 102 is coupled to the upper portion of the casing string and the lower body 112 is coupled to the lower portion of the casing string. The swivel assembly 101 creates a connection between the upper body 102 and the lower body 112, such that manipulation of the swivel assembly 101 provides for selective application of torque to the lower portion of the casing string.

At step 804, the casing string and tool 100 are run into a wellbore, the swivel assembly 101 starting in the first configuration as shown in FIG. 1 such that the upper body 102 and the lower body are rotationally 104 locked and torque applied to the upper portion of the casing string is transferred to the lower portion of the casing string. In embodiments, the opening seat 108 engaged with the upper and lower torque retainers 118, 120 creates the torque lock of the first configuration.

At step 806, one or more pumping operations are performed as would be understood by those skilled in the art.

At step 808, as desired, the swivel assembly 101 is converted into the second configuration, the second configuration unlocking the upper body 102 from the lower body 112 such that torque no longer transfers from the upper portion of the casing string to the lower portion of the casing string. In embodiments, the disengagement of the lock from the first configuration is achieved by applying a predetermined pressure to the opening sleeve 105 and opening seat 108, such as through launching of an opening plug, wherein the opening sleeve 105 and opening seat 105 are forced from a first position (FIG. 1) to a second position (FIG. 2), the second position releasing the opening seat 108 from the upper and lower torque retainers 118, 120. This disengagement prevents torque transfer to the lower body 112 and to the lower portion of the casing string.

At step 810, one or more fluid circulation operations are performed. For example, in embodiments, fluid is circulated from inside of the swivel assembly 101 to outside the swivel assembly 101 through one or more circulation ports 106.

At step 812, the swivel assembly 101 is converted into the third configuration, wherein the circulation ports 106 are closed off via the closing sleeve 116. In embodiments, a force, such as a second plug, causes the closing sleeve 116 to shift from a first position to a second position, thereby blocking the circulation ports 106 in the second position.

At step 814, the tool 100 may be drilled out to create a full-bore flow path through the tool 101.

The tool 100 and method of use described herein provide for a plurality of benefits and features that are unique over the prior art. Namely, the tool 100 is configured to allow for rotation of an upper section of the casing after completing the first stage cementing operations, the tool 100 allows for rotation of an upper section of casing after inflation of annular casing packers installed on a lower section of the casing below the tool 100, the tool 100 allows for rotation of an upper section of casing after swelling of swell packers installed on a lower section of the casing below the tool 100, and the tool allows for rotation of the upper section of the casing that includes screens that cannot be rotated.

Those skilled in the art will appreciate that casing movement during circulating and cementing provides benefits, including in hole cleaning and mud displacement efficiency. Conventional systems with stage cementing tools cannot be rotated after a first stage is performed or if any type of annular packers are installed below the stage tool. The invention presented herein provides for a tool 100 that allows rotation of an upper section of pipe/casing that has not been possible in conventional operations. Accordingly, the tool 100 and method of use of the present invention provides for improved cementing operations that can be performed that result in improved zonal isolation within the wellbore.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. An integral swivel tool for selectively allowing a transmission of torque to a casing string at a position below installation of the integral swivel tool along the casing string, the integral swivel tool comprising:

an upper body configured to engage with an upper portion of the casing string;

a lower body configured to engage with a lower portion of the casing string; and a swivel assembly connecting the upper body to the lower body, the swivel assembly is configured to operate in a first configuration, a second configuration, and a third configuration to selectively allow the transmission of torque through the swivel assembly, the swivel assembly having:

a case swivel body mechanically coupled to the upper body and having the one or more circulation ports;

an opening seat positioned within the case swivel body, the opening seat coupled to the case swivel body with an upper torque retainer and coupled to the lower body with a lower torque retainer while in the first configuration;

a swivel retainer coupled to the case swivel body and engaged with the lower body such that swivel retainer can rotate independent of the lower body; and a closing sleeve positioned within the case swivel body at a position above the opening seat;

wherein the opening seat is configured to disengage from the upper torque retainer and the lower torque retainer upon receiving a predetermined pressure;

wherein disengagement of the opening seat from the upper torque retainer and the lower torque retainer shifts the swivel assembly from the first configuration to the second configuration; and wherein the closing sleeve is configured to shift from a first position to a second position upon receiving a predetermined force, the second position resulting in the closing sleeve blocking the one or more circulation ports;

wherein the first configuration locks the upper body and the lower body such that torque can be transmitted from the upper portion of the casing string to the lower portion of the casing string through the integral swivel tool;

wherein the second configuration unlocks the upper body from the lower body such that torque is not transmitted from the upper portion of the casing string to the lower portion of the casing string through the integral swivel tool, the second configuration further opening one or more circulation ports for fluid flow through the swivel assembly; and wherein the third configuration blocks the one or more circulation ports, the third configuration allowing for the integral swivel tool to be drilled out to a full-bore flow path through the integral swivel tool while maintaining pressure integrity.

2. The integral swivel tool of claim 1, further comprising:

the opening seat having a tubular body with a plurality of splines extending parallel with the tubular body;

the upper torque retainer having a first plurality of interior grooves for locking with the plurality of splines; and the lower torque retainer having a second plurality of interior grooves for locking with the plurality of splines;

wherein locking of the first plurality of interior grooves and the second plurality of interior grooves with the plurality of splines, locks the swivel assembly into the first configuration such that torque is transmitted through the swivel assembly.

3. The integral swivel tool of claim 2, wherein the lower torque retainer further comprises a plurality of exterior grooves to engage with a plurality of locking members extending from the lower body, thereby locking the lower torque retainer with the lower body.

4. The integral swivel tool of claim 2, wherein the plurality of splines extend partially along the tubular body such that an upper portion of the tubular body is free of splines, wherein when the predetermined pressure is applied to the opening seat, the tubular body is pushed through the upper torque retainer and the lower torque retainer.

5. The integral swivel tool of claim 1, further comprising:

the lower body including a shoulder protruding from an exterior surface of the lower body; and the swivel retainer including a shelf protruding inwardly from an interior surface of the swivel retainer;

wherein the shoulder and the shelf engage such that the swivel retainer remains coupled to the lower body while allowing for the swivel retainer to rotate independently from the lower body.

6. A method of selectively allowing a transmission of torque to a casing string at a position below installation of an integral swivel tool along the casing string, the method comprising:

installing the integral swivel tool along a midpoint of the casing string, the integral swivel tool having an upper body to engage with an upper portion of the casing string, a lower body to engage with a lower portion of the casing string, and a swivel assembly connecting the upper body to the lower body, the swivel assembly configured to operate in a first configuration, a second configuration, and a third configuration, wherein installing the integral swivel tool further comprises:

coupling a case swivel body to the upper body, the case swivel body having one or more circulation ports;

coupling an opening seat to the case swivel body with an upper torque retainer and to the lower body with a lower torque retainer;

coupling a swivel retainer to the case swivel body and with the lower body such that swivel retainer can rotate independent of the lower body; and positioning a closing sleeve within the case swivel body at a position above the opening seat;

running the casing string and the integral swivel tool into a wellbore, the swivel assembly starting in the first configuration such that the upper body and the lower body are rotationally locked and torque applied to the upper portion of the casing string is transferred to the lower portion of the casing string;

performing one or more pumping operations;

converting the swivel assembly into a second configuration, the second configuration unlocking the upper body from the lower body such that torque no longer transfers from the upper portion of the casing string to the lower portion of the casing string;

performing one or more fluid circulation operations such that fluid is circulated from inside of the swivel assembly to outside the swivel assembly through the one or more circulation ports;

converting the swivel assembly into a third configuration, the third configuration blocking the one or more circulation ports; and allowing the integral swivel tool to be drilled out to create a full-bore flow path through the integral swivel tool.

7. The method of claim 6, wherein converting the swivel assembly into the second configuration comprises:

applying a predetermined pressure to the opening seat to disengage the opening seat from the upper torque retainer and the lower torque retainer, thereby preventing torque from transferring from the upper portion of the casing string to the lower portion of the casing string.

8. The method of claim 7, wherein converting the swivel assembly into the third configuration comprises:

shifting the closing sleeve from a first position to a second position upon receiving a predetermined force, the second position resulting in the closing sleeve blocking the one or more circulation ports.

* * * * *